US005584545A

United States Patent [19]

LaVaute et al.

[11] Patent Number: 5,584,545

[45] Date of Patent: Dec. 17, 1996

[54] SNEEZE GUARD

[76] Inventors: Peter A. LaVaute; Sydney W. Baumgartner, both of 10260 E. Hwy. OO, Hallsville, Mo. 65255

[21] Appl. No.: 272,355

[22] Filed: Jul. 8, 1994

[51] Int. Cl.[6] ..... A47B 96/18; A47F 9/00

[52] U.S. Cl. ..... 312/140.4; 108/115; 40/606; 312/114; 312/137; 312/229

[58] Field of Search ..... 312/140.4, 114, 312/140, 137, 229, 249.8, 351.9; 403/106, 108, 109, 83; 40/155, 152–160, 606, 611, 645; 108/129, 115

[56] References Cited

U.S. PATENT DOCUMENTS

| | | | |
|---|---|---|---|
| D. 206,198 | 11/1966 | Molitor . | |
| D. 337,462 | 7/1993 | LaVante et al. | D6/491 |
| 1,044,814 | 10/1911 | Peterson . | |
| 1,446,997 | 2/1923 | Tennant | 40/157 |
| 1,635,394 | 7/1927 | Anderson | 40/606 X |
| 2,776,508 | 1/1957 | Hutson | 40/155 |
| 2,841,902 | 7/1958 | Pfundt | 40/606 X |
| 2,857,228 | 10/1958 | Koett | 108/115 |
| 3,080,193 | 3/1963 | Nimmo | 108/115 X |
| 3,817,310 | 6/1974 | Petersen . | |
| 3,847,250 | 11/1974 | Sherrill . | |
| 4,013,880 | 3/1977 | Kennedy, Jr. et al. . | |
| 4,121,362 | 10/1978 | Knuth | 40/155 |
| 4,214,392 | 7/1980 | Virsen | 40/155 X |
| 4,250,680 | 2/1981 | Bomar | 40/152 X |
| 4,254,569 | 3/1981 | Janik | 40/606 |
| 4,280,294 | 7/1981 | Eckberg, II | 40/606 |
| 4,368,586 | 1/1983 | Forzelias | 40/606 X |
| 4,528,998 | 7/1985 | Gamm | 403/108 X |
| 4,630,386 | 12/1986 | Wilson | 40/155 |
| 4,658,527 | 4/1987 | Pingel | 40/606 |
| 4,662,092 | 5/1987 | Kim | 40/155 |
| 4,862,612 | 9/1989 | Sugihara et al. | 40/155 |
| 4,892,366 | 1/1990 | Yerman . | |
| 4,974,352 | 12/1990 | Chen | 40/155 X |
| 5,012,603 | 5/1991 | Elcock | 40/606 X |
| 5,082,334 | 1/1992 | Beyer et al. . | |
| 5,095,642 | 3/1992 | George et al. | 40/606 |
| 5,199,811 | 4/1993 | Huang | 403/108 |
| 5,307,574 | 5/1994 | Huff, Jr. | 40/152 |
| 5,353,536 | 10/1994 | Erber et al. | 40/157 X |

FOREIGN PATENT DOCUMENTS

| | | | |
|---|---|---|---|
| 415303 | 6/1925 | Germany | 403/108 |
| 642417 | 9/1950 | United Kingdom | 403/108 |
| 2028945 | 3/1980 | United Kingdom | 403/108 |

OTHER PUBLICATIONS

Continental Carlisle Price List #FSLP–1290, Oklahoma City, Oklahoma, pp. 1–3 and 6–8, Dec. 1, 1990.

ProTec, Ship'n Out Co., Brewster, N.Y., pp. 1–8, 1988.

Clear–View Sneeze Guards, Crescent Metal Products, Inc., Cleveland, Ohio, pp. 1–4 1988.

Sneeze Guards, Lawrence Metal Products, Inc., Bay Shore, N.Y., pp. 52 and 53, Circa. 1990.

Sneeze Guards, Lavi Industries, Valencia, California, p. 12, 1989.

*Primary Examiner*—Peter M. Cuomo

*Assistant Examiner*—Rodney B. White

*Attorney, Agent, or Firm*—Klaas, Law, O'Meara & Malkin, P.C.

[57] ABSTRACT

A sneeze guard having a guard assembly comprising an acrylic pane held within a channeled tubular frame, a pair of swept back support legs, and a spring-pin assembly for detachably mounting said guard assembly on said legs and for independently pivoting each of said legs with respect to said guard assembly to either an open or closed position.

12 Claims, 5 Drawing Sheets

FIG. 6
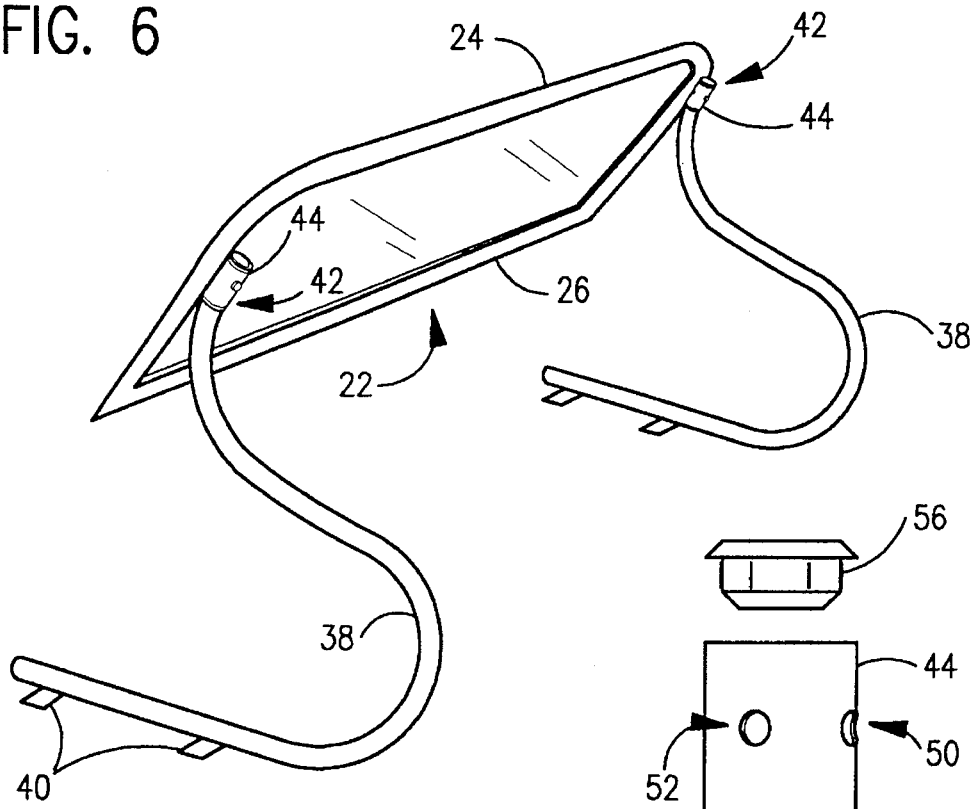
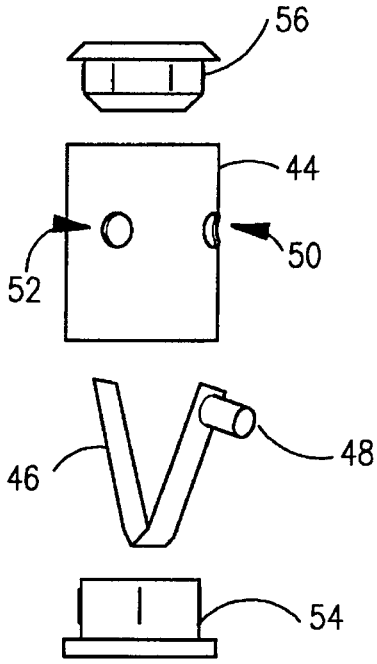
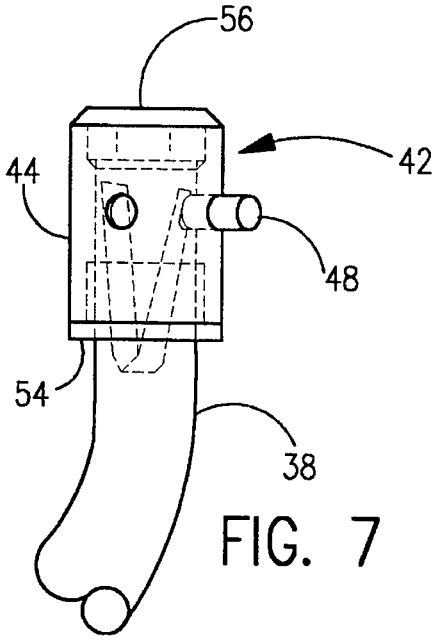
FIG. 7
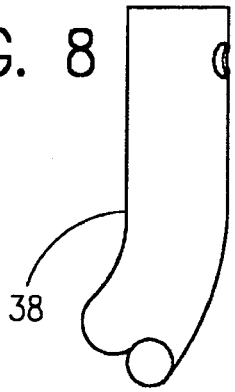
FIG. 8

SNEEZE GUARD

BACKGROUND

This invention pertains to sneeze guards for use in conjunction with food buffets and the like found in banquet halls, convention centers, country clubs, night clubs, restaurants and other institutions. More particularly, this invention pertains to a portable sneeze guard that is labor saving, durable, efficient and attractive.

Compliance with food service health and safety codes requires that there be a barrier or shield between a customer and the food served by a restaurant or other food service institution. In order to comply with such codes, a variety of sneeze guards have been invented. However, prior sneeze guards have posed several problems.

First, efficient utilization of floor space often requires that food buffets and the like be set up and torn down on a frequent basis. Conventional barriers pose several problems in this regard. Foremost, it is difficult for a single person to efficiently set up or tear down a conventional serving line comprising several sneeze guards. Most prior sneeze guards have been rigid, cumbersome devices, sometimes with lights and/or a counter attached. See for example U.S. Pat. Nos. 5,082,334, 4,013,880 and 3,847,250. Also, as a result of being cumbersome, prior sneeze guards have been prone to being scratched and broken as they are carried from a storage area to a serving line.

The guards for a large establishment can also require extensive and valuable storage space, as they are not foldable or stackable.

Furthermore, many guards are constructed such that the barrier shield may not readily be removed for cleaning or replacement thereof.

Yet another disadvantage of prior sneeze guards is the requirement for frontal support elements that can interfere with access to food by patrons or by personnel who continually restock the food items of a buffet. In this regard, note U.S. Pat. Nos. 4,892,366 and 3,817,310.

It is therefore the object of this invention to remove the aforesaid inconveniences.

SUMMARY

In the achievement of the foregoing object, the inventors have invented a sneeze guard having a guard assembly comprising an acrylic pane held within a channeled tubular frame, a pair of swept back support legs, and a spring-pin assembly for detachably mounting said guard assembly on said legs and for independently pivoting each of said legs with respect to said guard assembly to either an open (usable) or closed (stored) position.

It is a very important advantage of the present invention to provide a sneeze guard that is labor saving, allowing one person to quickly assemble a multitude of sneeze guards so as to erect a buffet or serving line.

Another important object of this invention is to provide a sneeze guard which is light weight, yet durable.

Yet another object of this invention is to provide a sneeze guard which may quickly be folded for ease of portability or storage.

A further objective of this invention is to provide sneeze guards which may be used individually, side by side, or back to back in an attractive manner. Their support legs sweep back and away from the access side of the sneeze guards, thereby eliminating bothersome frontal support members.

Still another objective of this invention is to provide a sneeze guard which has a removable barrier shield for easier cleaning or replacement thereof.

These and other important benefits and objectives of the present invention will be further explained or will become apparent from the accompanying description, drawings and claims.

BRIEF DESCRIPTION OF THE DRAWINGS

Following is a description and brief explanation of each drawing, wherein:

FIG. 6 is a rear perspective view of the sneeze guard of FIG. 1;

FIG. 7 is an enlarged perspective view of a spring-pin assembly shown in FIG. 6, the view being slightly rotated from the view of FIG. 6;

FIG. 8 is an exploded perspective view of the spring-pin assembly shown in FIG. 7;

DESCRIPTION OF THE PREFERRED EMBODIMENT

Figure 1:
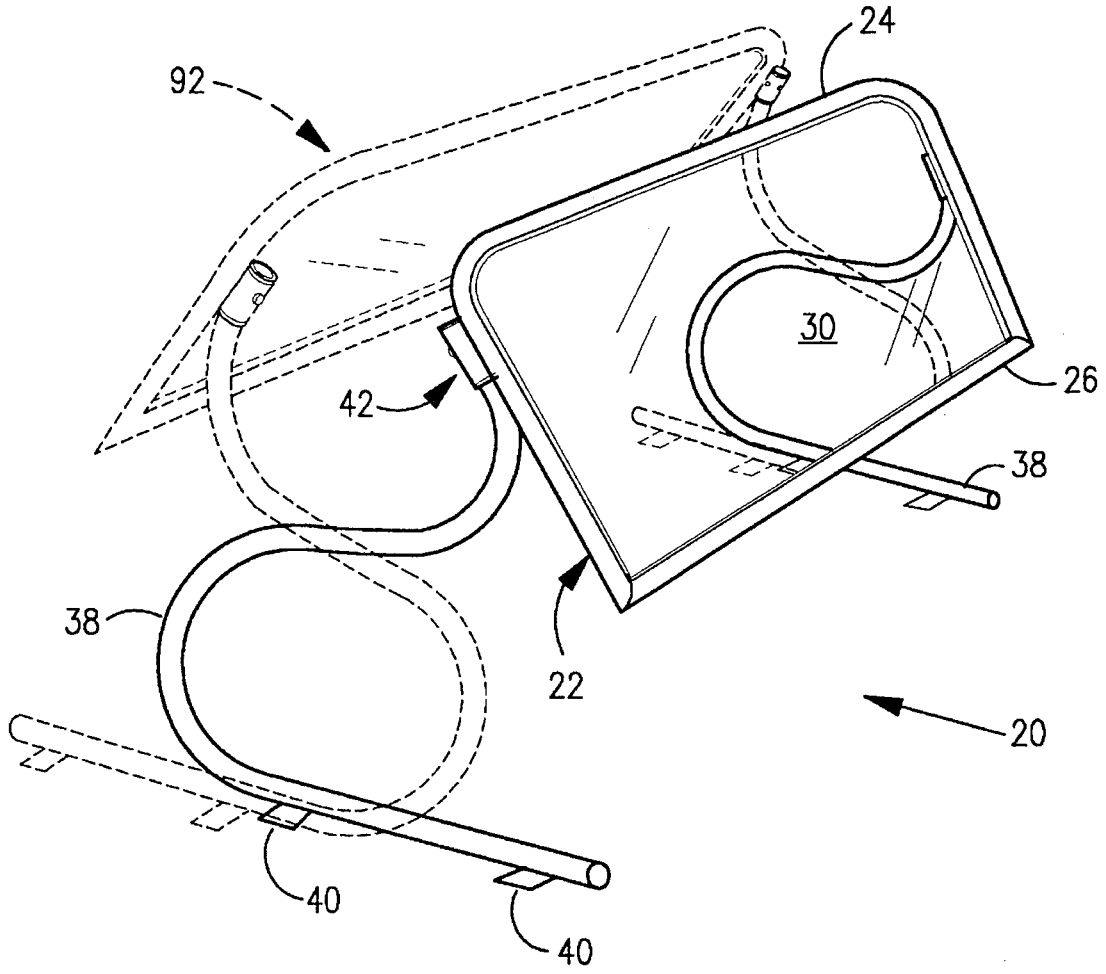
FIG. 1 is a perspective view of a sneeze guard embodying the principles of this invention.

A sneeze guard embodying the principles of this invention is broadly designated in FIG. 1 by reference numeral 20. The sneeze guard shown essentially comprises two elements, a guard and a pair of legs for supporting the guard.

Figure 2:
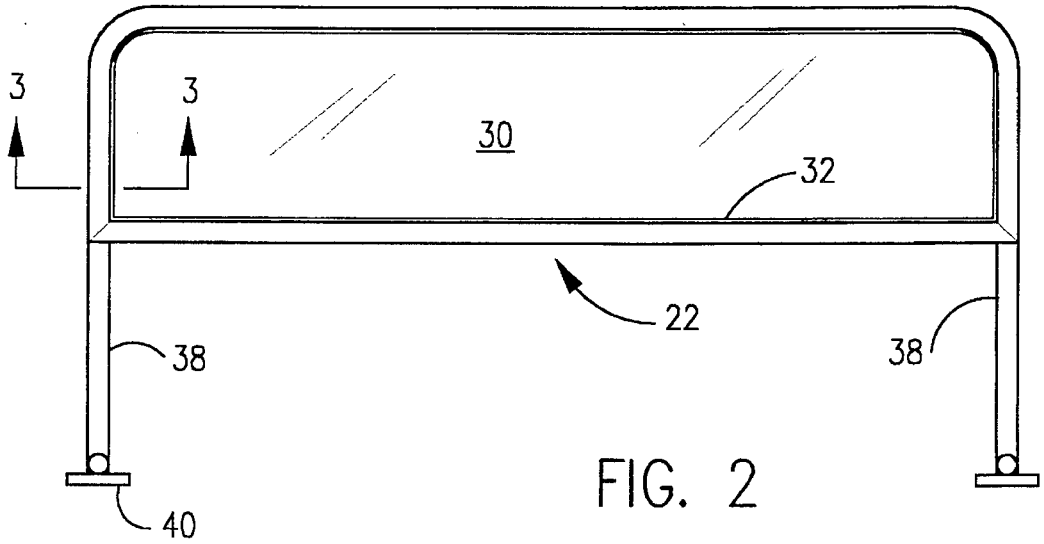
FIG. 2 is a front elevational view of the sneeze guard of FIG. 1.

The guard comprises a pane 30 housed in a channeled tubular frame 22 (FIG. 2). The channeled tubular frame is preferably constructed of aluminum tubing having a diameter of approximately one inch (2.54 cm) and a length-wise channel approximately one-half inch (1.26 cm) deep and 5/16" (0.8 cm) wide. Although not important to the spirit of the invention, dimensions for the guard frame of 16½" (42 cm) high and from four to six feet (122 to 183 cm) wide have been found to be suitable for most uses.

The pane consists of an acrylic panel (although glass or other transparent material may be used) which has the advantages of being light weight and shatterproof.

Figure 4:
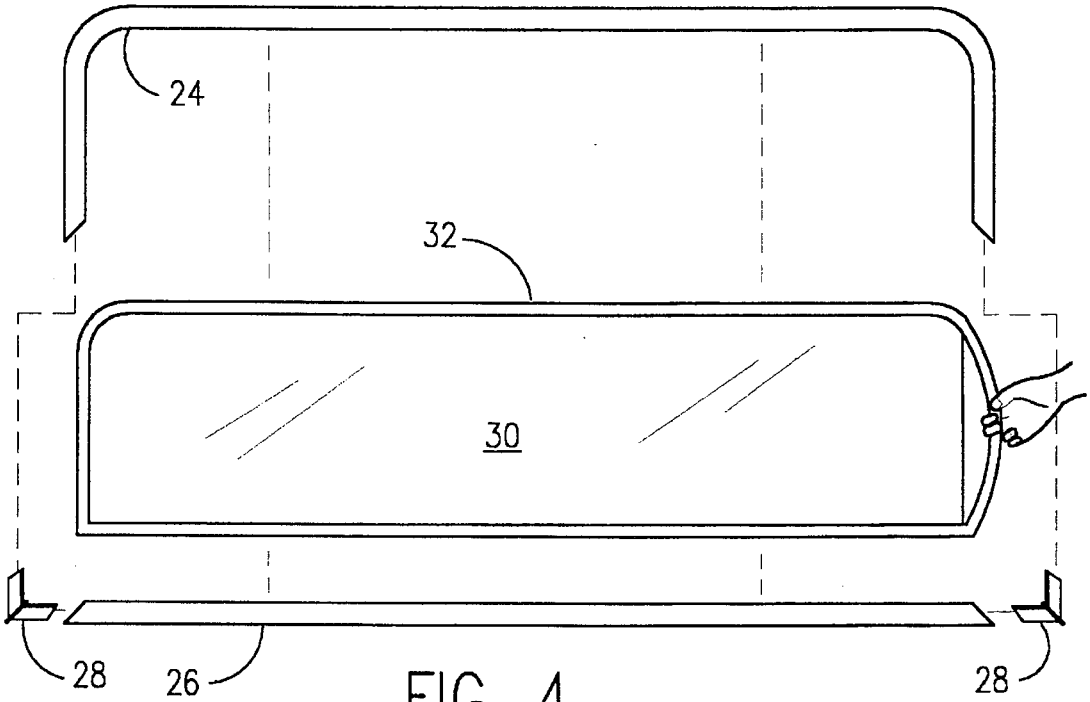
FIG. 4 is a view of the guard assembly of the sneeze guard of FIG. 3, exploded to show details of construction.

Frame 22 further comprises upper and lower channeled tubular sections joined by connectors 28. Upper frame section 24 is generally U-shaped, forming the top and sides of the guard frame 22. Lower frame section 26 is straight and forms the bottom of the guard frame. The ends of both the upper and lower frame sections are mitered at a 45 degree angle for joining with connector 28. A gasket 32 fits between pane 30 and frame 22. See FIG. 4.

Figure 3:
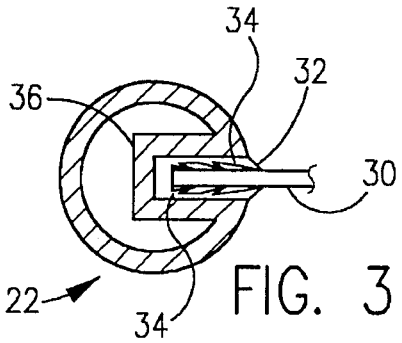
FIG. 3 is an enlarged cross sectional view along line 3—3 of FIG. 2.
Figure 5:
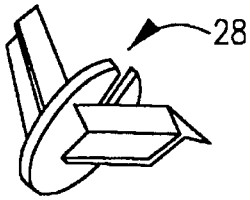
FIG. 5 is an enlarged perspective view of a connector used in assembling the sneeze guard of FIG. 4.

In use, gasket 32 is slid over the outer edges of pane 30. The pane, along with the gasket, is then slid into upper frame section 24. The gasket prevents food material and other debris from entering into channel 36, thus resulting in easier cleaning. Flanges 34 on gasket 32, angled away from the pane and running the length of the gasket, serve to stabilize and cushion pane 30 within frame 22 and prevent cracking of the pane (FIG. 3). Connectors 28 are mounted in the channels on each end of lower frame section 26 before that section is slid over the gasket on the bottom edge of pane 30 and the connectors 28 are guided into the open channels of the upper frame section. Connectors 28 are shown in more detail in FIG. 5. Disassembly is the reverse of assembly. It should be noted that no tools are required. Consequently, the guard may be easily disassembled for replacement of a scratched or otherwise damaged pane.

Tubular legs 38 made of aluminum or the like support guard assembly 20. Each curvilinear leg is more or less S-shaped, thereby sweeping back from the serving line and allowing patrons or servers easier access to items displayed under the guard. It is notable that the swept back leg design eliminates any frontal support member for the guard. Feet 40 mounted to the legs add additional stabilization to the sneeze guard. See FIG. 6.

Figure 9:
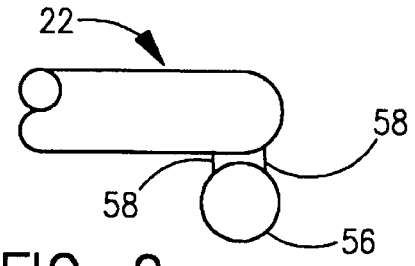
FIG. 9 is a top plan view of an upper corner portion of the sneeze guard of FIG. 1.

Legs 38 are foldable and detachable with respect to the guard assembly via locking spring-pin assemblies 42 (FIGS. 7 & 8). The female parts of spring-pin assemblies 42 consist of sleeves 44 welded to opposite sides of upper frame section 24 for acceptance of legs 38. Holes 50 and 52 are drilled into the rear and inner walls of each sleeve for acceptance of a spring-pin (the holes are offset by 90 degrees). The upper ends of legs 38 contain spring-pins 46. The spring-pins shown consist of five inch (12.7 cm) lengths of high grade steel having pins 48 formed into one end thereof. The steel is then bent to an approximately 60 degree angle before being inserted into the upper tubular end of a leg. Rearwardly protruding holes, approximately one inch down from the upper ends of the legs, allow for protrusion of pins 48 through the legs. A lower bushing 54 and an upper bushing cap 56 take up slack between the legs and the sleeves and provide a smooth, reduced friction surface for insertion and rotation of the legs. The bushing cap also serves to cover the upper open end of sleeve 44, the open end of tubular leg 38, and weld lines between sleeves 44 and upper frame section 24 (FIG. 9).

Figure 11:
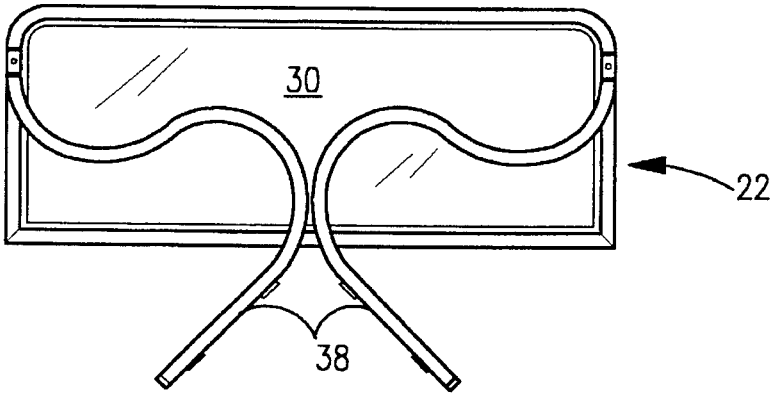
FIG. 11 is a reduced scale rear elevational view of the sneeze of FIG. 1 with its legs folded for storage.

In use, spring-pin 46 is inserted into leg 38 so that pin 48 protrudes from the hole in the leg. See FIG. 7. Bushing 54 is then slid onto leg 38 so that it is stationed just below pin 48. Bushing cap 56 is pushed into the top of sleeve 44. The leg assembly is then snapped into sleeve 44 such that bushings 54 and 56 stabilize leg 38 within sleeve 44 and provide for low friction movement of the leg. A user may push pins 48 and swivel legs 38 so that each pin 48 is aligned with either hole 50 or 52. Consequently, the legs may be locked in an open (usable) or closed (stored) position, respectively. A guard with its legs in a closed or stored position is shown in FIG. 11. It will be noted that when both legs are locked closed, the depth of the sneeze guard is approximately two and one-half inches (6.35 cm), and several guards may therefore be stored in a shallow storage space.

Figure 10:
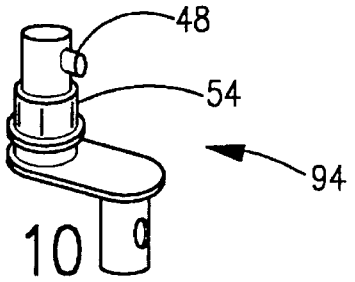
FIG. 10 is a perspective view of an elevator element which may be used in conjunction with the sneeze guard of FIG. 1.

An elevator 94 is available to raise and extend the entire guard assembly four inches (FIG. 10). The offset nature of the elevator insures that raising the guard does not alter its position with respect to a table, i.e. it keeps the front edge of the guard uniformly positioned with respect to a table edge.

Figure 12:
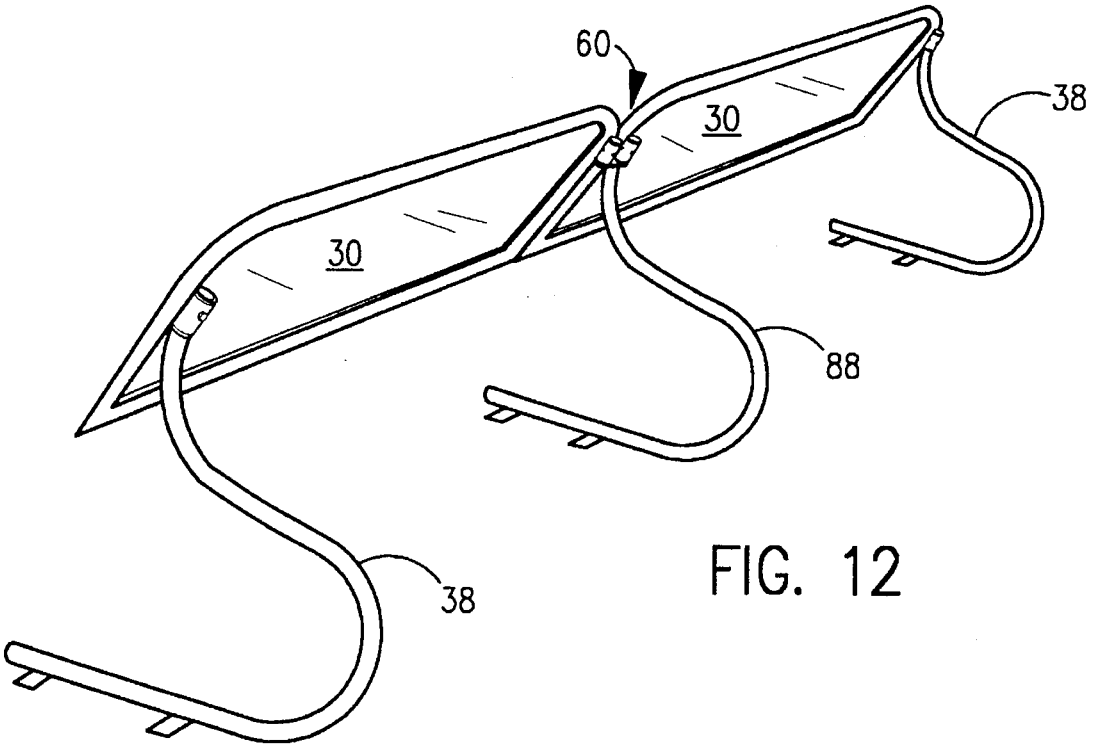
FIG. 12 is a reduced scale rear perspective view of two sneeze guards assembled side by side using a bridge leg.

A bridging leg 88 is available for situations wherein a row of sneeze guards are assembled. The bridging leg is topped with a dual spring-pin assembly 60 for acceptance of sleeves of two adjacent sneeze guards. See FIG. 12.

Two serving lines may be arranged back to back by placing two or more sneeze guards back to back on a table as shown in FIG. 1. Since the back to back serving lines are not joined, they may be arranged so as to cover a variety of table widths. Most prior sneeze guards were designed for use with a single table size.

Figure 13:
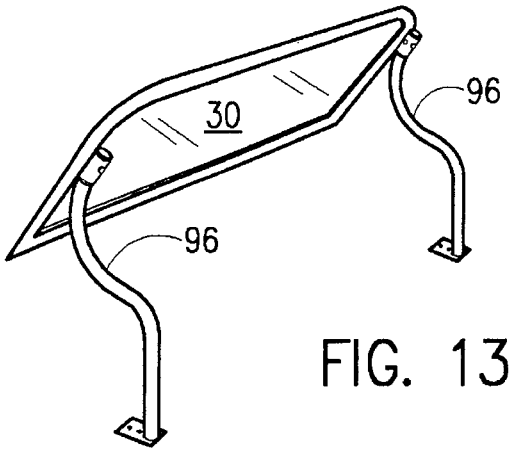
FIG. 13 is a view of a sneeze guard having a modified leg designed for permanent mounting.

An alternative embodiment of the invention, shown in FIG. 13, provides a modified leg 96 which is suitable for a guard of the type described herein that would be permanently mounted to a table top. Feet attached to modified legs 96 provide three mounting holes. Two threadless mounting holes are positioned in front of each leg 96. A third hole (not shown) is positioned under each leg and is threaded for acceptance of a mounting bolt.

Figure 14:
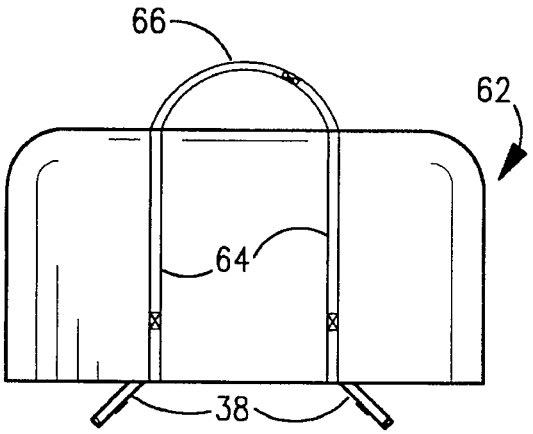
FIG. 14 is a view of a sneeze guard stored within a storage bag.

A storage bag is provided for storing a single folded sneeze guard (FIG. 14). The bag 62 fits over the top of a folded sneeze guard. Two adjustable straps 64 extend from the bottom of the bag and engage legs 38 to prevent the sneeze guard from falling out of the bag. A third adjustable strap 66 serves as a carrying handle for the bag. The stored guard may be hung on the wall by strap 66 or set on the floor using extending legs 38 as a base.

Figure 15:
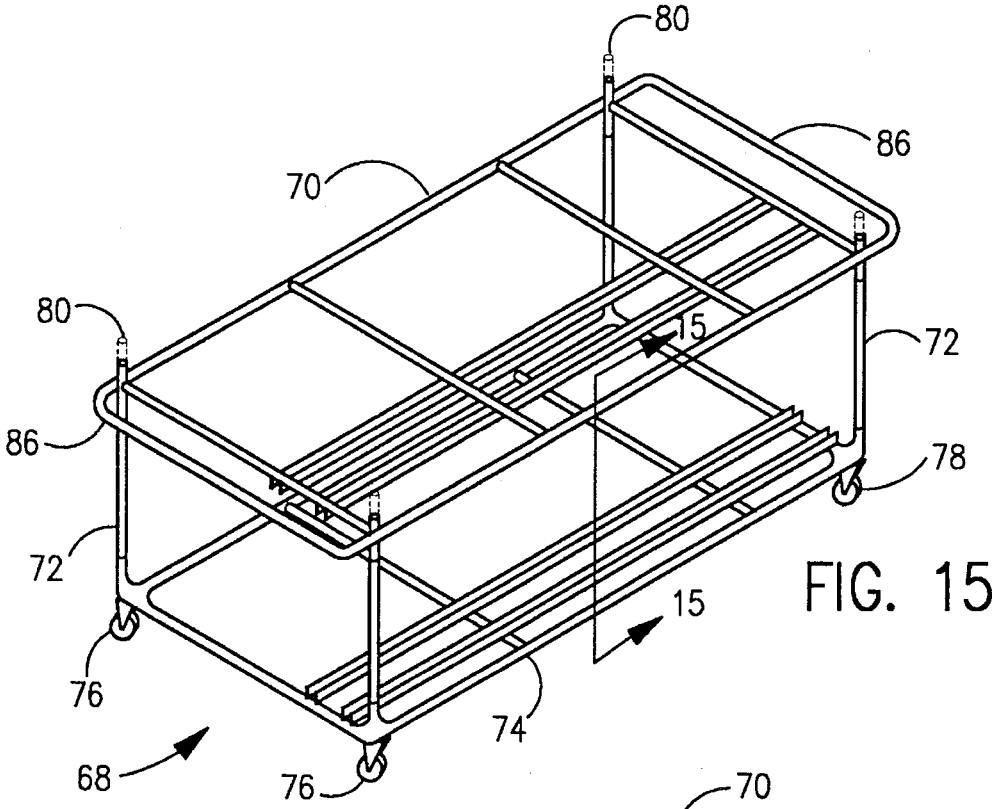
FIG. 15 is a perspective view of a storage cart which can store several sneeze guards.

A storage cart 68 is provided for storage of multiple folded sneeze guards (FIG. 15). The cart comprises a box like frame detachably mounted on casters. The cart is most suitably constructed from tubular steel sections. The top of the cart 70 detaches from uprights 72. Handles 86 are provided at each end of top 70. Uprights 72 in turn detach from base 74. Casters may be detachably mounted to base 74. The inventors have found that a combination of two locking swivel casters 76 at one end of the cart and two braking swivel casters 78 at the opposite end of the cart works best. For storage of an increased number of sneeze guards, a second base, uprights and cart top may be stacked on top of cart 70 using union connectors 80.

Figure 16:
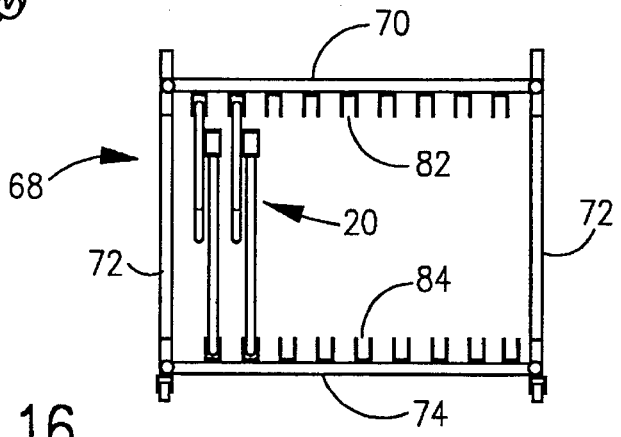
FIG. 16 is a front elevational view of the storage cart of FIG. 15.

Sneeze guards are stored on the cart by folding them and then sliding them into staggered upper and lower tracks 82 and 84, respectively, running the length of the cart. The inventors have specifically designed a cart with nine upper and lower track sets as shown in cross section in FIG. 16. For purposes of clarity, the cart in FIG. 15 only shows two such track sets. Upper tracks 82 may be deeper than the lower tracks so as to steady the guards and prevent them from tipping. The cart should be of sufficient length such that guards of any conceivable length may be stored in combination on the cart. Suitable cart dimensions for the storage of nine sneeze guards are 29"H×30"W×70"L (74 cm×76 cm×178 cm).

In use, a single person can quickly maneuver the sneeze guard storage cart to a remote location and assemble or dismantle a serving line without the aid of tools or other personnel.

The frames of both the sneeze guard and storage cart may be painted, treated or "powder coated" in a variety of colors.

Although the invention has been shown and described with respect to preferred embodiments, it is obvious that various modifications and changes may be made without departing from the spirit and scope of the invention.

Having described our invention, we claim:

1. A sneeze guard comprising:

a) a guard assembly comprising a tubular frame having an inwardly facing channel, and a transparent pane mounted within said channel, said tubular frame comprising two or more sections, detachably connected, one from the other, so as to release said pane from said frame, and two or more connectors for attaching said guard frame sections;

b) one or more legs;

c) means for detachably mounting said guard assembly on said one or more legs; and d) means for independently pivoting each of said one or more legs with respect to said guard assembly to either an open or closed position, wherein said mounting means and said pivoting means are attached directly to the tubular frame of the guard assembly.

2. A sneeze guard as in claim 1 wherein said guard assembly further comprises a gasket interposed between said pane and said guard frame.

3. A sneeze guard as in claim 1 wherein said one or more legs comprises first and second legs, each leg being substantially curvilinear, first sweeping back from said guard assembly, away from a point where it is detachably mounted to said guard assembly, then coming forward, towards said guard assembly, to form a substantially flat base for supporting said sneeze guard, said first and second legs establishing a center of gravity for said sneeze guard such that when the sneeze guard is in use, a need for frontal support members to balance said sneeze guard in an upright position is eliminated.

4. A sneeze guard as in claim 3, wherein said first and second legs have substantially tubular cross-sections.

5. A sneeze guard as in claim 1 wherein said one or more legs comprises:

a) first and second legs, each leg being substantially curvilinear, first sweeping back from said guard assembly, away from a point where it is detachably mounted to said guard assembly, then extending downwardly to first and second leg ends, respectively; and b) means, attachable to said first and second leg ends, for anchoring said sneeze guard to a surface.

6. A sneeze guard comprising:

a) a guard assembly;

b) one or more legs;

c) means for detachably mounting said guard assembly on said one or more legs, wherein said means for detachably mounting said guard assembly on said one or more legs comprises:

i) one or more sleeves attached to said guard assembly, said sleeves having first sleeve holes drilled therein for receiving one or more spring-pins:

ii) one or more leg extensions, coextensive with said one or more legs, said extensions having outer cross-sections which are slightly reduced in scale, but otherwise identical to inner cross-sections of said sleeves, said extensions having holes drilled therein for receiving one or more spring-pins; and iii) one or more spring-pins contained within said leg extensions, whereby said one or more legs may be detachably mounted to said guard assembly in an open position by inserting said leg extensions into said sleeves such that said spring-pins protrude through said leg extension holes and said first sleeve holes in locking engagement; and means for independently pivoting each of said one or more legs with respect to said guard assembly to either an open or closed position.

7. A sneeze guard as in claim 6 wherein said means for detachably mounting said guard assembly on said one or more legs further comprises:

a) one or more lower bushings, encircling said leg extensions just below said spring-pins; and b) one or more upper bushings, encircling said leg extensions just above said spring-pins, whereby when said legs are mounted to said guard assembly, said upper and lower bushings take up slack and reduce friction between said sleeves and said leg extensions.

8. A sneeze guard as in claim 6 wherein said cross-sections of said sleeves and said leg extensions are uniform and round.

9. A sneeze guard as in claim 8 wherein said sleeves have second sleeve holes drilled therein, said second holes being offset approximately 90 degrees from said first holes, whereby said legs may be pivoted to either an open position by aligning said spring-pins with said first holes, or to a closed position by aligning said spring-pins with said second holes, said means for detachably mounting said guard assembly on said one or more legs also serving as said means for independently pivoting each of said one or more legs with respect to said guard assembly.

10. A sneeze guard as in claim 9 wherein said means for detachably mounting said guard assembly on said one or more legs and said means for independently pivoting each of said one or more legs with respect to said guard assembly further comprise:

a) one or more lower bushings, encircling said leg extensions just below said spring-pins: and b) one or more upper bushings, encircling said leg extensions just above said spring-pins, whereby when said legs are mounted to said guard assembly, said upper and lower bushings take up slack and reduce friction between said sleeves and said leg extensions.

11. A sneeze guard as in claim 6 wherein said guard assembly comprises two or more panes housed within individual frames, said frames having a sleeve attached to each of two opposite ends, said panes being aligned so that a horizontal line extends through said sleeves.

12. A sneeze guard as in claim 11, wherein said one or more legs comprise:

a) two end legs having single leg extensions extending therefrom, said end legs being mounted to a pair of outermost sleeves along said horizontal line of panes; and b) one or more bridge legs having dual leg extensions extending therefrom, said bridge legs being mounted to a pair of sleeves of two adjacent panes along said horizontal line of panes.

* * * * *